United States Patent [19]

Sakakibara

[11] Patent Number: 4,543,056

[45] Date of Patent: Sep. 24, 1985

[54] SAFETY DEVICE FOR FAN HEATER

[75] Inventor: Kuniyoshi Sakakibara, Handa, Japan

[73] Assignee: Rinnai Corporation, Nagoya, Japan

[21] Appl. No.: 678,951

[22] Filed: Dec. 6, 1984

Related U.S. Application Data

[63] Continuation of Ser. No. 332,643, Dec. 21, 1981, abandoned.

[30] Foreign Application Priority Data

Feb. 3, 1981 [JP] Japan ..... 56-15265

[51] Int. Cl.[4] ..... F23N 5/00

[52] U.S. Cl. ..... 431/76; 236/15 E; 431/29

[58] Field of Search ..... 431/75, 76; 432/37; 236/15 E; 126/94, 95, 96

[56] References Cited

U.S. PATENT DOCUMENTS

| | | | |
|---|---|---|---|
| 2,532,214 | 11/1950 | Willenburg | 431/76 X |
| 2,604,312 | 7/1952 | Anderson et al. | 126/110 C |
| 2,972,475 | 2/1961 | Monroe | 126/110 C X |
| 3,061,294 | 10/1962 | Ohmstede | 236/15 E X |
| 3,403,962 | 10/1968 | Suffron et al. | 431/20 |
| 3,404,836 | 10/1968 | Hickam | 236/15 E |
| 4,032,285 | 6/1977 | Rohr et al. | 431/76 X |
| 4,163,441 | 8/1979 | Chen | 126/110 C X |
| 4,395,226 | 7/1983 | Nakanishi et al. | 431/76 |
| 4,396,001 | 8/1983 | Ogino et al. | 126/96 |

FOREIGN PATENT DOCUMENTS

| | | | |
|---|---|---|---|
| 162236 | 12/1979 | Japan | 431/20 |
| 99523 | 7/1980 | Japan | 431/76 |

*Primary Examiner*—Samuel Scott
*Assistant Examiner*—Carl D. Price
*Attorney, Agent, or Firm*—Nilsson, Robbins, Dalgarn, Berliner, Carson & Wurst

[57] ABSTRACT

The safety valve of a fan heater is operated by a detector pipe, the outlet of which is shielded from its inlet and communicates with the warm wind circulating fan of the heater to forcibly draw burned gas into the detector pipe for stable flow therethrough. A timed delay stops operation of the fan only after the flow of gas has been shut off by the safety valve for a time sufficient to discharge combusted gas from the detector pipe.

2 Claims, 2 Drawing Figures

SAFETY DEVICE FOR FAN HEATER

This is a continuation of application Ser. No. 332,643, filed Dec. 21, 1981, now abandoned.

BACKGROUND AND SUMMARY OF THE INVENTION

This invention relates to a safety device for fan heaters to prevent accidents resulting from the lack of oxygen.

In the conventionally known device of this kind, the burned gas from the burner is led through the draft to a detector pipe having a cylindrical oxygen density cell by which the density of oxygen in the burned gas is directly detected to operate the safety valve. In this case, however, if the burned gas should flow in unstable condition through the detector pipe and the combustion be stopped leaving the burned gas in the cylindrical oxygen density cell (the atmosphere in the heater then has a small amount of oxygen), the heater would fail to be reignited.

To eliminate the above drawback, it is desired that the burned gas be made to flow stably through the cylindrical detector pipes.

The object of this invention is to provide a safety device satisfying the above requirement which comprises: a detector pipe into which the burned gas from the burner is led; a cylindrical oxygen density cell having electrodes on the inner and outer surfaces thereof, the oxygen density cell being built into the detector pipe; a warm wind circulating fan with which the outlet of the detector pipe is communicated; whereby the safety valve in the gas pipe is operated by the output from the oxygen density cell. The oxygen density cell is a sintered, oxygen ion conductive solid electrolyte, such as zirconia, of a cylindrical shape with porous electrodes such as platinum formed on the inner and outer surfaces thereof. When heated to a predetermined operating temperature, the oxygen density cell generates voltage of a magnitude according to the oxygen density difference between the outer and inner atmospheres contacting the outer and inner electrodes.

DETAILED DESCRIPTION

Figure 1:
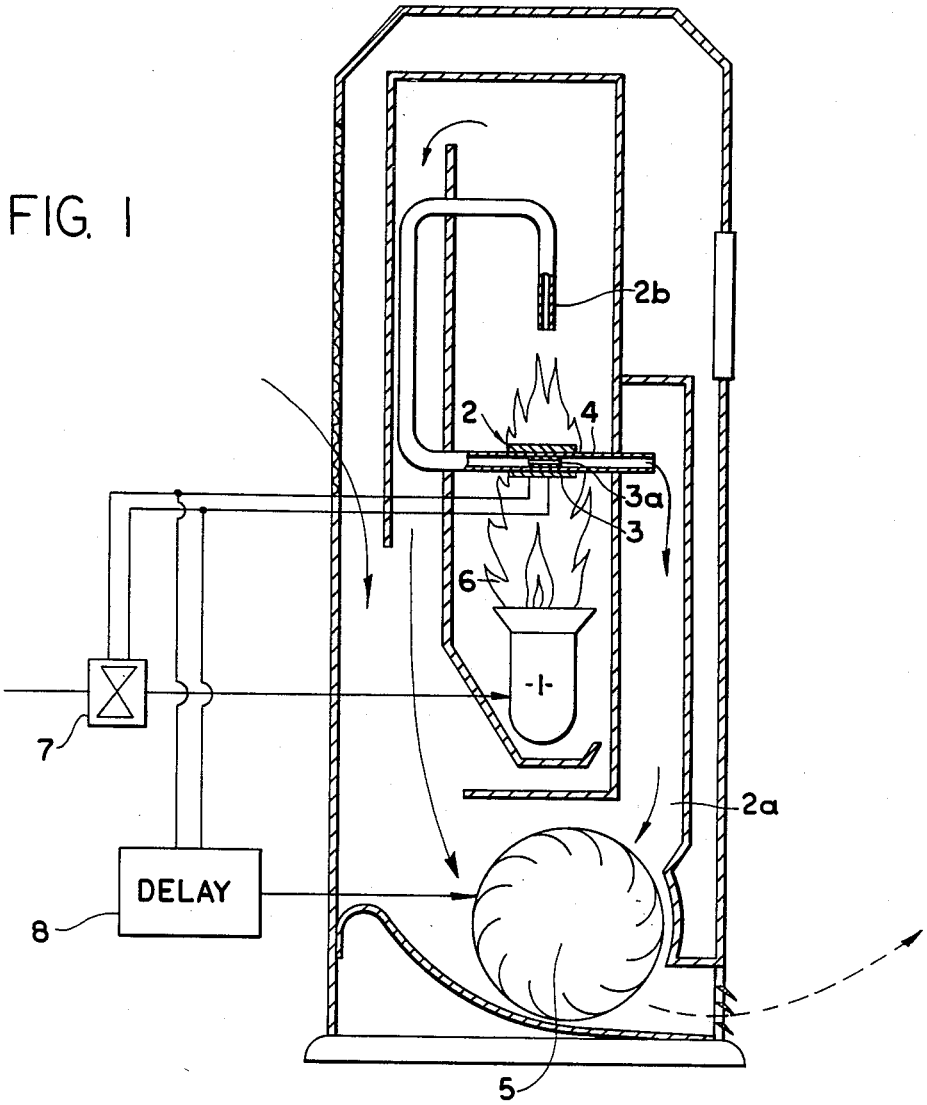
FIG. 1 is a schematic cross section of a fan heater incorporating the safety feature of this invention, showing only the main components.
Figure 2:
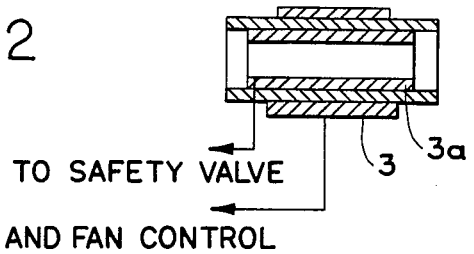
FIG. 2 is an enlargement of the oxygen density cell portion of FIG. 1.

One embodiment of this invention will now be explained with reference to the accompanying drawing. The attached drawing shows the cross section of an open type fan heater. An inlet opening 2*b* of a detector pipe 2 is placed above the burner 1 and an outlet opening 2*a* of the detector pipe 2 is shielded from the inlet thereof and is communicated with the warm wind circulating fan 5. When the fan 5 is operated, the burned gas from burner 1 is drawn into the inlet opening 2*b* and passed through the detector pipe 2 which is disposed subject to the flame 6 of the burner 1. The detector pipe 2 has an oxygen density cell 4.

Now, the action of the device will be explained. The oxygen density cell 4 has its outer electrode 3 exposed to the burning flame 6 and is therefore subjected to the atmosphere of low oxygen density, and the inner electrode 3*a* is exposed to the burned gas whose oxygen density is relatively high when the gas is normally burned. Thus, the inner electrode 3*a* is subjected to the atmosphere of relatively high oxygen density. When the detector is heated to a predetermined operating temperature, it produces a voltage of a magnitude according to the difference in oxygen density at the inner electrode 3*a* and outer electrode 3 and the resulting voltage causes the safety valve 7 to be opened. When the amount of oxygen reduces, i.e. when the oxygen density in the burned gas reduces, the difference in the oxygen density between the inner and outer electrodes 3*a* and 3 decreases to reduce the voltage, thereby closing the safety valve 7. In this case, since the voltage response or sensitivity of the oxygen density cell 4 to the variation in the oxygen density difference between the inner and outer electrodes 3*a* and 3 is very high, there is a possibility of undesired operation of the safety valve when the burned gas flows in pulsation or in unstable condition through the detector pipe 2 or when reignition is attempted under the atmosphere containing residual burned gas formed when the flame was put out in the previous turn-off operation. This possibility, however, can be precluded by operating the fan 5 which ensures stable flow of burned gas through the detector pipe 2 and by providing a time delay 8 in stopping the operating of the fan 5 so that the fan 5 continues to operate for a time sufficient to completely discharge the combusted gas from the detector pipe 2.

The features and advantages of this invention may be summarized as follows.

The outlet 2*a* of the detector pipe 2 is communicated with the fan 5 so that the burned gas is forcibly drawn into the detector pipe 2 by the fan 5 and therefore is made to flow through the pipe 2 in stable condition, regardless of the length and shape of the detector pipe 2. The cylindrical oxygen density cell 4 built into the detector pipe 2 reliably monitors the oxygen density in the burned gas so that as soon as the oxygen density in the burned gas decreases or when the oxygen is deficient, the safety valve can quickly be closed: thus ensuring safety of the device. Furthermore, the device of this invention prevents the residual burned gas from staying in the detector pipe so that undesired operation of the safety valve can be prevented at the time of reignition.

I claim:

1. In a safety device for a fan heater said fan heater including a burner utilizing a flame to burn gas and having a safety valve in a gas supply pipe said safety valve being capable of both permitting gas to flow to said burner and shutting off the flow of gas to said burner, a detector pipe disposed at least partially in the combustion products flow path of said flame, said detector pipe having an inlet into which said combustion products from the burner are drawn and an outlet from which said combustion products emerge, a first portion of an oxygen density cell in the detector pipe, and a second portion of said oxygen density cell exposed to said flame, and a warm wind circulating fan for drawing air to be heated and said combustion products through said fan heater, the improvement including means shielding the outlet of the detector pipe from the inlet thereof and from said burner and for directing burned gas from said outlet away from said burner and into communication with the warm wind circulating fan to forceably draw burned gas into the detector pipe for stable flow therethrough.

2. The improvement of claim 1 including means for continuing to operate the fan for a time sufficient to discharge said combustion products from the detector pipe after the flow of gas has been shut off by the safety valve.

* * * * *